US012553439B2

(12) United States Patent
Komori et al.

(10) Patent No.: US 12,553,439 B2
(45) Date of Patent: Feb. 17, 2026

(54) SCROLL COMPRESSOR

(71) Applicant: Mitsubishi Electric Corporation, Tokyo (JP)

(72) Inventors: Kengo Komori, Tokyo (JP); Takuya Hotehama, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 278 days.

(21) Appl. No.: 18/565,093

(22) PCT Filed: Jun. 8, 2021

(86) PCT No.: PCT/JP2021/021708
§ 371 (c)(1),
(2) Date: Nov. 29, 2023

(87) PCT Pub. No.: WO2022/259358
PCT Pub. Date: Dec. 15, 2022

(65) Prior Publication Data
US 2024/0263632 A1 Aug. 8, 2024

(51) Int. Cl.
*F04C 29/06* (2006.01)
*F04C 15/06* (2006.01)
*F04C 18/02* (2006.01)

(52) U.S. Cl.
CPC ..... *F04C 29/065* (2013.01); *F04C 15/06* (2013.01); *F04C 18/0215* (2013.01); *F04C 29/068* (2013.01); *F04C 2270/135* (2013.01)

(58) Field of Classification Search
CPC ..... F04C 29/06; F04C 29/065; F04C 29/066; F04C 29/068; F04C 18/02; F04C 18/0207; F04C 18/0215
See application file for complete search history.

(56) References Cited

U.S. PATENT DOCUMENTS 5,674,061 A * 10/1997 Motegi ..... F04C 18/0253 418/57
2007/0292284 A1 12/2007 Morimoto et al.
2017/0074269 A1 3/2017 Katayama et al.

FOREIGN PATENT DOCUMENTS

JP 2006-132382 A 5/2006
JP 2017-053316 A 3/2017
JP 2018-053746 A 4/2018

OTHER PUBLICATIONS

International Search Report and Written Opinion mailed on Jul. 13, 2021, received for PCT Application PCT/JP2021/021708, filed on Jun. 8, 2021, 8 pages including English Translation.

* cited by examiner

*Primary Examiner* — Loren C Edwards
(74) *Attorney, Agent, or Firm* — XSENSUS LLP

(57) ABSTRACT

A scroll compressor includes a compression mechanism with a compression chamber. The compression chamber is a combination of a fixed scroll and an orbiting scroll, and is to compress working gas. The fixed scroll includes a main port, and a plurality of sub-ports. The main port is a port through which the working gas compressed in the compression chamber is to be discharged. The sub-ports are ports through which the working gas over-compressed in the compression chamber is to be discharged. The scroll compressor includes a rotary shaft, and a silencing chamber. The rotary shaft drives the compression mechanism. The silencing chamber is disposed downstream of the main port with respect to the flow of the working gas. The silencing chamber includes a discharge hole, an expansion part, and a plurality of chamber sub-ports. The discharge hole is a hole through which the working gas is to be discharged.

7 Claims, 19 Drawing Sheets

Comparative Example

Comparative Example

Comparative Example

Comparative Example

SCROLL COMPRESSOR

CROSS-REFERENCE TO RELATED APPLICATION

This application is based on PCT filing PCT/JP2021/021708, filed Jun. 8, 2021, the entire contents of which are incorporated herein by reference.

TECHNICAL FIELD

The present disclosure relates to a scroll compressor. More specifically, the present disclosure relates to a scroll compressor including a silencing chamber.

BACKGROUND ART

Scroll compressors include a compression mechanism with a compression chamber formed by a combination of a fixed scroll and an orbiting scroll. Refrigerant is compressed in the compression chamber. Refrigerant pulsations may occur as the compressed refrigerant is discharged from the compression chamber to the outside of the compression chamber. Such refrigerant pulsations may cause jet noise. In the related art, a compressor disclosed below is known as a compressor including means for suppressing jet noise.

A compressor described in Patent Literature 1 includes a discharge space to receive refrigerant discharged from a compression chamber. The discharge space includes two spaces, and a communication space connecting the two spaces to each other. The discharge space thus serves as a silencing space for effectively reducing noise.

CITATION LIST

Patent Literature

Patent Literature 1: Japanese Unexamined Patent Application Publication No. 2018-053746

SUMMARY OF INVENTION

Technical Problem

If the space for receiving refrigerant discharged from the compression chamber has a circular cross-section, a circular sound field is formed within an expansion part that defines the space, and thus an acoustic resonance mode occurs at a specific frequency. This leads to reduced silencing effect of the silencing chamber including the expansion part, and consequently to increased noise. In the case of a circular sound field, an acoustic resonance mode has an antinode and a node in each of the circumferential direction and the radial direction.

In Patent Literature 1, each space defining the discharge space has a circular cross-section, and thus has rotational symmetry about the rotation axis of the compression mechanism. According to Patent Literature 1, each space has rotational symmetry as described above. Consequently, when an acoustic resonance mode having an antinode and a node in the radial direction occurs, an acoustic resonant mode having the same sound pressure distribution and whose antinode and node and antinode locations have a 90-degree phase shift relative to the above-mentioned acoustic resonance mode occurs at a frequency very close to the frequency at which the above-mentioned acoustic resonance mode occurs. As a result, according to Patent Literature 1, the following acoustic resonance modes occur at frequencies very close to each other: an acoustic resonance mode with a sound pressure distribution whose antinode is positioned at the location of a main port, which is a discharge hole for refrigerant provided in the fixed scroll; and an acoustic resonance mode with a node positioned at the location of the main port. This leads to reduced silencing effect of the silencing space, and consequently to the inability to reduce noise resulting from refrigerant pulsations.

In a scroll compressor, working gas within the compression chamber may become over-compressed. The resulting excessive compression load on compressor bearings may cause the scroll compressor to malfunction. To prevent this, the fixed scroll of the scroll compressor includes, in addition to a main port, a sub-port through which the working gas over-compressed in the compression chamber is to be discharged. A need exists to reduce noise resulting from refrigerant pulsations for such a scroll compressor of a multi-port type including a main port and a sub-port.

The present disclosure has been made in view of the problem mentioned above. Accordingly, it is an object of the present disclosure to provide a scroll compressor of a multi-port type that allows for reduced noise resulting from refrigerant pulsations.

Solution to Problem

A scroll compressor according to an embodiment of the present disclosure includes a compression mechanism with a compression chamber. The compression chamber is formed by a combination of a fixed scroll and an orbiting scroll, and configured to compress working gas. The fixed scroll includes a main port, and a plurality of sub-ports. The main port is a port through which the working gas compressed in the compression chamber is to be discharged. The sub-ports are ports through which the working gas over-compressed in the compression chamber is to be discharged. The scroll compressor includes a rotary shaft, and a silencing chamber. The rotary shaft drives the compression mechanism. The silencing chamber is disposed downstream of the main port with respect to the flow of the working gas. The silencing chamber includes a discharge hole, an expansion part, and a plurality of chamber sub-ports. The discharge hole is a hole through which the working gas is to be discharged out of the silencing chamber. The expansion part is located upstream of the discharge hole. The expansion part is a recess that defines a space communicating with the main port. The chamber sub-ports each communicate with the corresponding one of the sub-ports. The expansion part is disposed between two of the chamber sub-ports. As seen in the axial direction of the rotary shaft, the expansion part is larger than the main port, and has a flattened shape.

Advantageous Effects of Invention

According to an embodiment of the present disclosure, the expansion part of the silencing chamber has a flattened shape as seen in the axial direction. The sound field formed by the expansion part thus has rotational asymmetry, which ensures frequency separation between acoustic resonance modes having the same sound pressure distribution and whose antinode and node locations have a 90-degree phase shift relative to each other. This helps to prevent an antinode of an acoustic resonance mode from being positioned at the discharge hole of the silencing chamber in the scroll compressor, and consequently to reduce noise resulting from refrigerant pulsations.

DESCRIPTION OF EMBODIMENTS

Embodiment 1

Structure According to Embodiment 1

Figure 1:
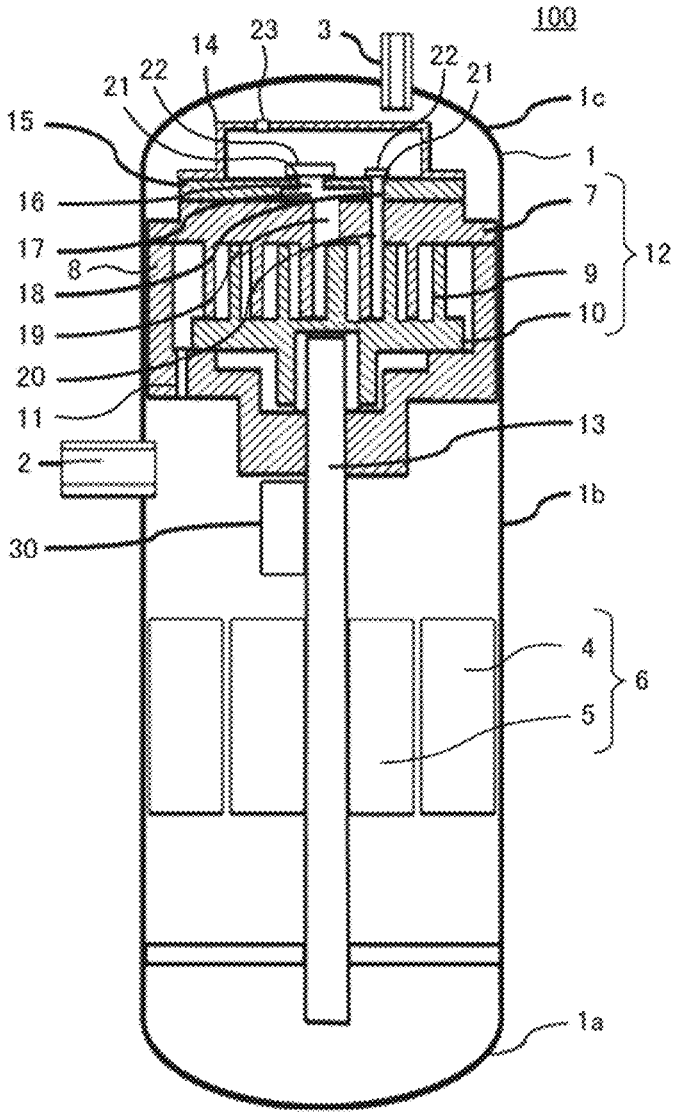
FIG. 1 is a schematic cross-sectional view of a scroll compressor according to Embodiment 1.
Figure 2:
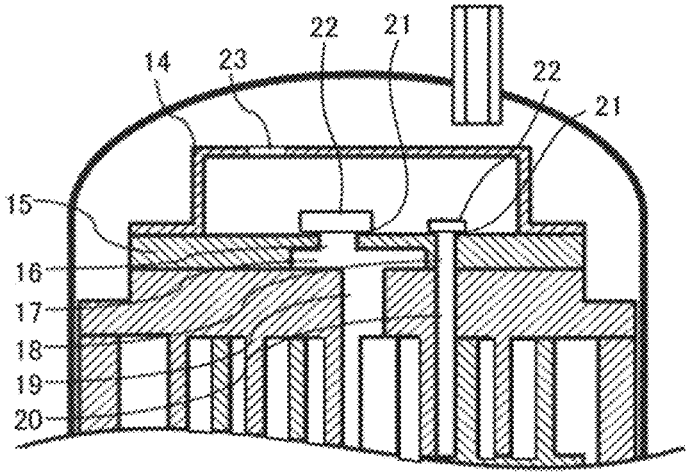
FIG. 2 is an enlarged schematic cross-sectional view of an area corresponding to a compression mechanism of the scroll compressor according to Embodiment 1.

FIG. 1 is a schematic cross-sectional view of a scroll compressor 100 according to Embodiment 1. FIG. 2 is an enlarged schematic cross-sectional view of an area corresponding to a compression mechanism 12 of the scroll compressor 100 according to Embodiment 1. Referring to FIGS. 1 and 2, the scroll compressor 100 sucks in refrigerant, which circulates in a refrigeration cycle system, through a suction pipe 2, and compresses the refrigerant in the compression mechanism 12 into a high-temperature, high-pressure state before discharging the resulting refrigerant through a discharge pipe 3. As illustrated in FIG. 1, the scroll compressor 100 includes a shell 1, an electric motor element 6, the compression mechanism 12, and a rotary shaft 13.

The shell 1 defines the outline of the scroll compressor 100. The shell 1 has a cylindrical shape. The shell 1 includes a lower shell 1*a*, a mid-shell 1*b*, and an upper shell 1*c*. The lower shell 1*a* is positioned at the bottom of the shell 1. The mid-shell 1*b* is welded to the lower shell 1*a*, and has a cylindrical shape. The upper shell 1*c* closes off the opening at the top of the mid-shell 1*b*. The suction pipe 2 is disposed at a side portion of the mid-shell 1*b*. The suction pipe 2 allows the working gas to be sucked into the shell 1. The discharge pipe 3 is disposed at a top portion of the upper shell 1*c*. The discharge pipe 3 allows the working gas to be discharged to the outside of the shell 1.

The electric motor element 6 includes a stator 4, and a rotor 5. The stator 4 is secured to the shell 1 by shrink-fitting or other methods. The rotor 5 is secured to the rotary shaft 13 by shrink-fitting or other methods. Upon supply of power to the stator 4, the rotor 5 rotates in response to a torque exerted from a rotating magnetic field generated in the stator 4. The rotation of the rotor 5 causes the rotary shaft 13 to be driven. The resulting driving force is transmitted to an orbiting scroll 10 described later. The orbiting scroll 10 makes an orbital movement while having its rotation prevented or reduced by an Oldham mechanism (not illustrated).

A balancer 30 is mounted to the rotary shaft 13. The balancer 30 is located between a frame 8 described later and the rotor 5. The balancer 30 serves to counterbalance an imbalance caused by the orbital movement of the orbiting scroll 10.

The frame 8 is disposed above the electric motor element 6 inside the shell 1. The frame 8 is secured to the shell 1. The frame 8 supports a fixed scroll 7, and the orbiting scroll 10. The frame 8 includes a suction port 11. The working gas flows into a compression chamber 9 described later through the suction port 11.

The compression mechanism 12 is disposed inside the shell 1 to compress the working gas flowing into the compression mechanism 12 through the suction port 11 as the electric motor element 6 is driven. The compression mechanism 12 is accommodated in the space inside the frame 8. The compression mechanism 12 includes the fixed scroll 7, and the orbiting scroll 10. The compression mechanism 12 includes the compression chamber 9, which is formed as the fixed scroll 7 and the orbiting scroll 10 are combined with each other in the axial direction of the rotary shaft 13 (hereinafter, simply "axial direction"). In the compression mechanism 12, as the rotary shaft 13 rotates, the compression chamber 9 moves with its volume decreasing from a radially outer portion toward a radially inner portion. The working gas within the compression chamber 9 is thus compressed.

The fixed scroll 7 is secured to the interior of the shell 1. The fixed scroll 7 is disposed over the frame 8. The fixed scroll 7 includes a main port 19, and sub-ports 20. The main port 19 is a port through which the working gas compressed in the compression chamber 9 is to be discharged. The sub-ports 20 are ports through which the working gas over-compressed in the compression chamber 9 is to be discharged. The main port 19 and the sub-ports 20 each extend through the fixed scroll 7 in the axial direction. A single main port 19 is provided in a central portion of the fixed scroll 7, and a plurality of sub-ports 20 are provided at radially outer locations relative to the main port 19.

A silencing chamber 15 is disposed on the fixed scroll 7 at a location downstream of the main port 19. The silencing chamber 15 is disposed on an end face of the fixed scroll 7 opposite from the orbiting scroll 10. The silencing chamber 15 is provided so that noise caused by the working gas blowing out of the main port 19 is reduced while the working gas communicates with the interior of the silencing chamber 15. A silencing muffler 14 is disposed at an end face of the silencing chamber 15 opposite from the fixed scroll 7, such that the silencing muffler 14 covers a discharge hole 16 and chamber sub-ports 18, which will be described later, of the silencing chamber 15. The silencing muffler 14 is provided so that noise caused by the working gas blowing out from the discharge hole 16 of the silencing chamber 15 is reduced before the working gas is blown out from an outlet hole 23 provided in the silencing muffler 14.

The silencing chamber 15 is a plate-shaped component. The silencing chamber 15 includes the discharge hole 16, and an expansion part 17. The discharge hole 16 is a hole through which the working gas is to be discharged to the outside of the silencing chamber 15. The expansion part 17 is disposed upstream of the discharge hole 16, and communicates with the discharge hole 16. The expansion part 17 is provided at a face of the silencing chamber 15 near the fixed scroll 7. The expansion part 17 is in the form of a recess defining a space that communicates with the main port 19. The expansion part 17 allows silencing to be performed by causing a sound wave to be reflected within the expansion part 17, and causing the reflected sound wave and a new incoming sound wave to interfere with each other. High-pressure working gas discharged from the main port 19 flows into the expansion part 17 of the silencing chamber 15. After passing through the expansion part 17, the working gas is discharged through the discharge hole 16 to the space inside the silencing muffler 14.

The silencing chamber 15 includes the chamber sub-ports 18 communicating with the corresponding sub-ports 20 of the fixed scroll 7. The same number of chamber sub-ports 18 as the number of sub-ports 20 are provided. The working gas becomes over-compressed under an operating condition in which the compression ratio is below an optimum compression ratio. Such over-compressed working gas flows from the compression chamber 9 into the chamber sub-ports 18 via the corresponding sub-ports 20 before reaching the center of the spiral. After entering the chamber sub-ports 18, the working gas is discharged to the space inside the silencing muffler 14.

A discharge valve 21 for opening and closing the discharge hole 16, and a valve guard 22 are disposed at a downstream end portion of the discharge hole 16 of the silencing chamber 15 with respect to the flow of refrigerant. Likewise, a discharge valve 21 for opening and closing the chamber sub-port 18, and a valve guard 22 are disposed at a downstream end portion of each chamber sub-port 18 of the silencing chamber 15 with respect to the flow of refrigerant. The working gas that has been compressed within the compression chamber 9 pushes up the discharge valve 21, which causes the working gas to be discharged to the space inside the silencing muffler 14. After being discharged to the space inside the silencing muffler 14, the working gas is introduced to the space between the upper shell 1*c* and the silencing muffler 14 by passing through the outlet hole 23 provided in the silencing muffler 14. The working gas is then discharged from the discharge pipe 3 to the outside of the scroll compressor 100.

As described above, the scroll compressor 100 employs a combination of the silencing chamber 15 and the silencing muffler 14 to achieve noise reduction.

According to Embodiment 1, jet noise resulting from pressure pulsations can be reduced through appropriate positioning and shaping of the expansion part 17 of the silencing chamber 15. This is now described below.

Figure 3:
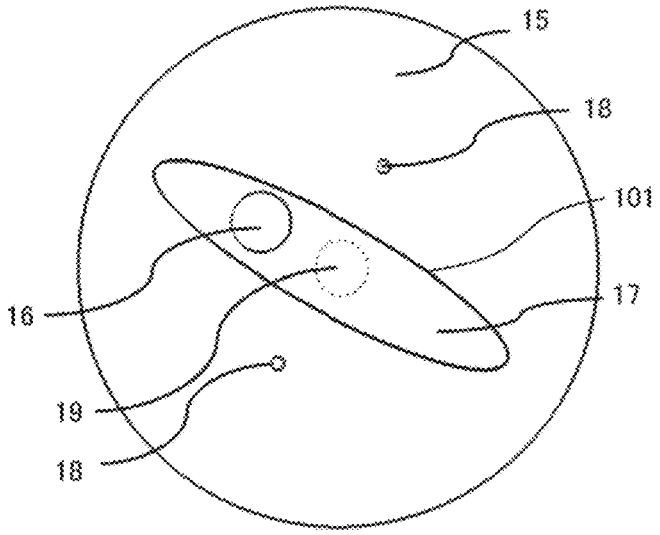
FIG. 3 is a plan view, as seen in the axial direction from a fixed scroll, of a silencing chamber according to Embodiment 1.
Figure 4:
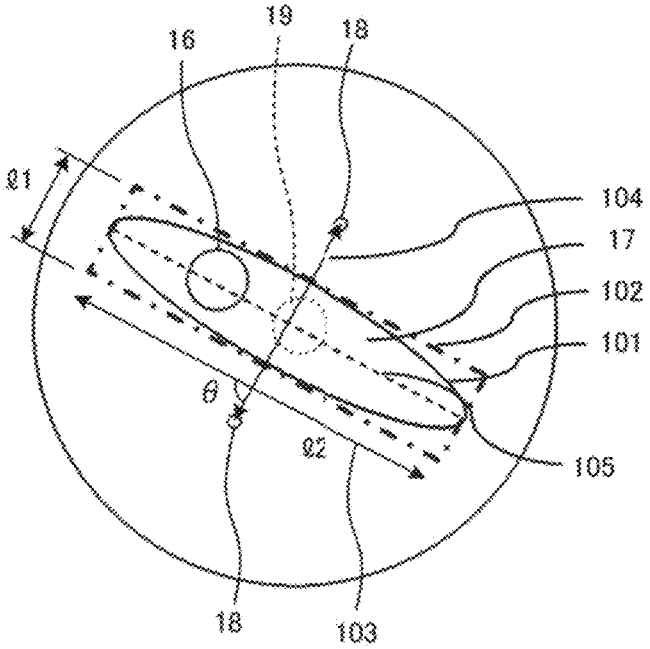
FIG. 4 is a cross-sectional illustration for explaining the shape of an expansion part of the silencing chamber according to Embodiment 1.

FIG. 3 is a plan view, as seen in the axial direction from the fixed scroll 7, of the silencing chamber 15 according to Embodiment 1. In FIG. 3, the dashed line represents the main port 19. FIG. 4 is a cross-sectional illustration for explaining the shape of the expansion part of the silencing chamber 15 according to Embodiment 1.

As illustrated in FIGS. 3 and 4, as seen in the axial direction of the rotary shaft 13, the expansion part 17 is larger than the main port 19 and smaller than the outer circumferential portion of the silencing chamber 15. As seen in the axial direction, the expansion part 17 is disposed between any two of the chamber sub-ports 18. The expansion part 17 has a flattened shape 101 as seen in the axial direction. That is, the cross-sectional shape of the expansion part 17 taken along a plane orthogonal to the rotary shaft 13 is the flattened shape 101. As used herein, the term "cross-sectional shape" or "cross-sectional area" refers to a cross-sectional shape or a cross-sectional area taken along a plane orthogonal to the rotary shaft 13. The flattened shape 101 refers to a generally flat shape having a major axis and a minor axis. Embodiment 1 is directed to an example in which the flattened shape 101 is an ellipse.

As illustrated in FIG. 4, the expansion part 17 is positioned such that a longitudinal direction 103 of a rectangle 102 circumscribing the flattened shape 101, and a straight line 104 connecting the respective centers of the chamber sub-ports 18 form an angle θ that satisfies the condition that 45 degrees≤θ≤135 degrees. The rectangle 102 has a length l2 in the longitudinal direction that is greater than the shortest distance between two chamber sub-ports 18. The length l2 in the longitudinal direction of the rectangle 102 is greater than or equal to five times the length l1 in the transverse direction of the rectangle 102, and less than the diameter of the silencing chamber 15. The length l1 in the transverse direction of the rectangle 102 is less than the shortest distance between two chamber sub-ports 18. The shortest distance between two chamber sub-ports 18 corresponds to the "length of the straight line 104" minus twice the "radius of each chamber sub-port." Examples of the flattened shape 101 include a rectangle. That is, examples of the expansion part 17 include an expansion part having a rectangular shape as seen in the axial direction.

The main port 19 and the discharge hole 16 lie on a central axis 105 that divides the rectangle 102 in two in the transverse direction.

Operation and Effects According to Embodiment 1

The silencing chamber 15 serves as a silencer used to address noise. Silencers can be roughly classified into the following two types: absorptive and reactive. Absorptive silencers utilize a fibrous or porous sound-absorbing material or other materials to absorb acoustic energy within a conduit. By contrast, reactive silencers utilize reflections or interferences of sound waves. The silencing chamber 15 corresponds to a reactive silencer.

Several methods exist to evaluate the silencing effect of silencers. In the following description, the silencing effect is evaluated based on the amount of noise reduction NR. The amount of noise reduction NR is defined as the difference between a sound pressure level $L_{p1}$ at the silencer inlet, and a sound pressure level $L_{p2}$ at the silencer outlet. The amount of noise reduction NR is given by Equation (1).

[Math. 1]

$$NR = L_{p1} - L_{p2} \tag{1}$$

Equation (1) indicates that when the amount of noise reduction NR is positive, the sound pressure level ($L_{p2}$) at the silencer outlet is lower than the sound pressure level ($L_{p1}$) at the silencer inlet, and thus noise has been suppressed by the silencer. That is, the greater the amount of noise reduction NR, the greater the silencing effect provided by the silencer.

In the following description, the silencing effect is evaluated by a method including performing a computer simulation by use of an acoustic analysis model of the expansion part 17 of the silencing chamber 15, and calculating the respective sound pressure levels at the inlet and outlet of the silencing chamber 15, and the sound pressure distributions of acoustic resonance modes that occur within the silencing chamber 15.

Figure 5:
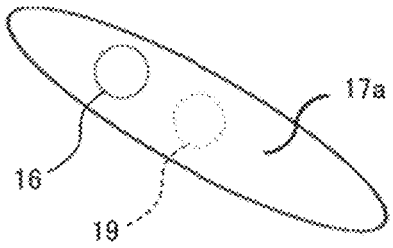
FIG. 5 illustrates an acoustic analysis model of the silencing chamber according to Embodiment 1.
Figure 6:
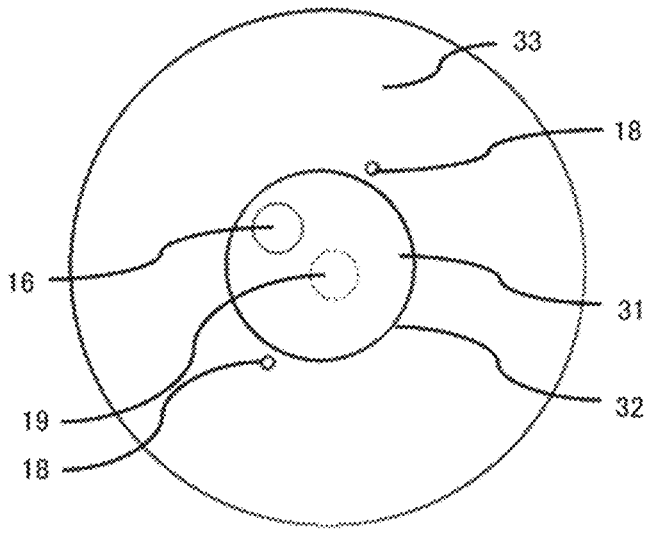
FIG. 6 is a plan view, as seen in the axial direction from the fixed scroll, of a silencing chamber including an expansion part according to Comparative Example.
Figure 7:
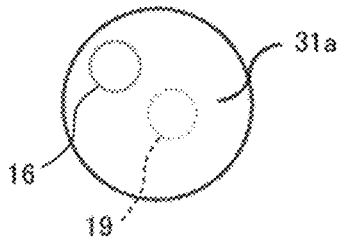
FIG. 7 illustrates an acoustic analysis model of the silencing chamber according to Comparative Example.

FIG. 5 illustrates an acoustic analysis model 17*a* of the silencing chamber 15 according to Embodiment 1. FIG. 6 is a plan view, as seen in the axial direction from the fixed scroll, of a silencing chamber 33 including an expansion part 31 according to Comparative Example. The silencing chamber 33 according to Comparative Example is a silencing chamber with the expansion part 31 whose cross-section has a circular shape 32. That is, as seen in the axial direction, the silencing chamber 33 is a silencing chamber whose expansion part has the circular shape 32. FIG. 7 illustrates an acoustic analysis model 31*a* of the silencing chamber 33 according to Comparative Example. The expansion part 17 according to Embodiment 1 has a cross-sectional area equal to the cross-sectional area of the expansion part 31 according to Comparative Example. In the following description, the silencing effect of the silencing chamber 15 according to Embodiment 1 is compared with the silencing effect of the silencing chamber 33 according to Comparative Example.

The acoustic analysis model 17*a* is a model in which the expansion part 17 of the silencing chamber 15 is filled with finite elements, and in which the main port 19 serves as an input face and the discharge hole 16 serves as an outlet face. The acoustic analysis model 31*a* is a model in which the expansion part 31 of the silencing chamber 33 is filled with finite elements, and in which the main port 19 serves as an input face and the discharge hole 16 serves as an outlet face. An acoustic analysis was conducted using the acoustic analysis models 17*a* and 31*a*. The analysis was conducted using the following conditions: a particle velocity of 1 [m/s] was given to the input face; air was used as fluid: the acoustic velocity c was 340 [m/s]; and the air density r was 1.225 [kg/m$^3$]. The amount of noise reduction NR was calculated by substitution of the sound pressure level $L_{p1}$ at the input face and the sound pressure level $L_{p2}$ at the outlet face into Equation (1).

Figure 8:
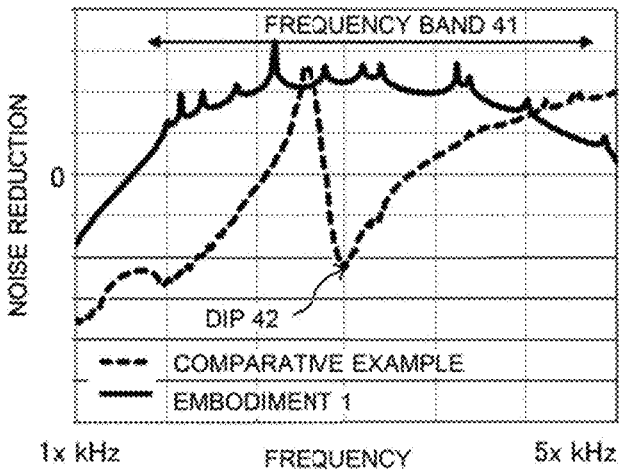
FIG. 8 is a graph representing the characteristics of the acoustic analysis results on the expansion part of the silencing chamber according to Embodiment 1 and on the expansion part of the silencing chamber according to Comparative Example, illustrating the amount of noise reduction with respect to frequency.

FIG. 8 described below illustrates the results of the analyses performed using the acoustic analysis model 17*a* illustrated in FIG. 5 and the acoustic analysis model 31*a* illustrated in FIG. 6.

FIG. 8 is a graph representing the characteristics of the acoustic analysis results on the expansion part 17 of the silencing chamber 15 according to Embodiment 1 and on the expansion part 31 of the silencing chamber 33 according to Comparative Example, illustrating the amount of noise reduction with respect to frequency. In FIG. 8, the solid line represents the characteristics according to Embodiment 1, and the dashed line represents the characteristics according to Comparative Example. As illustrated in FIG. 8, according to Embodiment 1, the amount of noise reduction is positive within a frequency band 41. That is, Embodiment 1 provides a silencing effect over the frequency band 41, which covers a wide range of frequencies. However, Comparative Example exhibits a decrease in the amount of noise reduction due to the presence of a dip 42.

Figure 9:
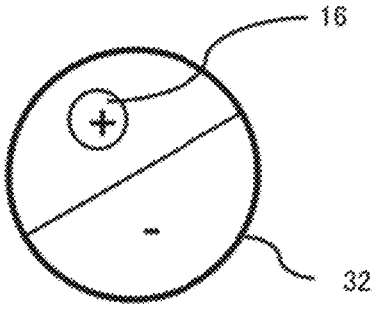
FIG. 9 conceptually illustrates the sound pressure distribution of an acoustic resonance mode in the expansion part of the silencing chamber according to Comparative Example.
Figure 10:
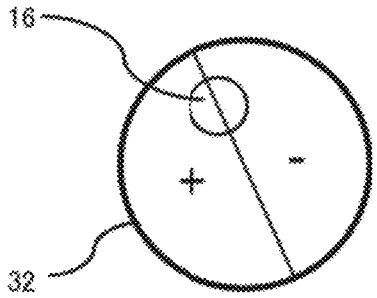
FIG. 10 conceptually illustrates the sound pressure distribution of an acoustic resonance mode in the expansion part of the silencing chamber according to Comparative Example.

FIGS. 9 and 10 each illustrate an acoustic resonance mode that was confirmed to occur in the expansion part 31 as a result of the simulation performed using the acoustic analysis model 31*a* illustrated in FIG. 7.

Figure 11:
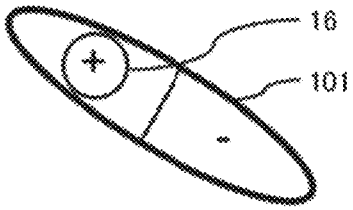
FIG. 11 conceptually illustrates the sound pressure distribution of an acoustic resonance mode in the expansion part of the silencing chamber according to Embodiment 1.
Figure 12:
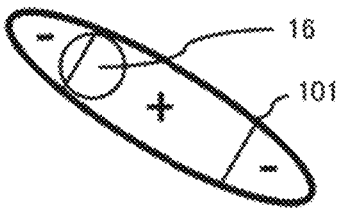
FIG. 12 conceptually illustrates the sound pressure distribution of an acoustic resonance mode in the expansion part of the silencing chamber according to Embodiment 1.
Figure 13:
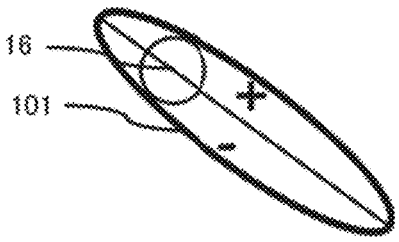
FIG. 13 conceptually illustrates the sound pressure distribution of an acoustic resonance mode in the expansion part of the silencing chamber according to Embodiment 1.

FIGS. 9 and 10 each conceptually illustrate the sound pressure distribution of an acoustic resonance mode in the expansion part 31 of the silencing chamber 33 according to Comparative Example. FIGS. 11, 12, and 13 each conceptually illustrate the sound pressure distribution of an acoustic resonance mode in the expansion part 17 of the silencing chamber 15 according to Embodiment 1. In FIGS. 9 to 13, "+" and "−" represent antinodes of acoustic resonance modes, and thin lines represent nodes.

As illustrated in FIGS. 9 and 10, it was confirmed from the simulation results that in the silencing chamber 33 according to Comparative Example, two acoustic resonance modes each having a single node in the radial direction occur very close to each other at the frequency of the dip 42. That is, in the silencing chamber 33 according to Comparative Example, acoustic resonance modes occur that have the same sound pressure distribution and whose antinode and node locations have a 90-degree phase shift relative to each other. This is because the expansion part 31 according to Comparative Example has a circular cross-sectional shape, and thus the sound field formed by the expansion part 31 has rotational symmetry about the rotary shaft 13. In the acoustic resonance mode illustrated in FIG. 10, the discharge hole 16 is positioned at a node. This results in increased amount of noise reduction. In the acoustic resonance mode illustrated in FIG. 9, however, the discharge hole 16 is positioned at an antinode. This results in decreased amount of noise reduction. As used herein, the term "radial direction" representing the direction of a node refers to the direction of a straight line connecting two points on the outer circumference of an acoustic resonance mode.

In the silencing chamber 33 according to Comparative Example, the acoustic resonance mode illustrated in FIG. 9 and the acoustic resonance mode illustrated in FIG. 10 occur in sequence. Accordingly, the acoustic resonance mode illustrated in FIG. 10 allows for increased amount of noise reduction due to the discharge hole 16 of the silencing chamber 33 being positioned at a node of the acoustic resonance mode. However, the acoustic resonance mode illustrated in FIG. 9 occurs at a frequency very close to the frequency at which the acoustic resonance mode illustrated in FIG. 10 has occurred. In the acoustic resonance mode illustrated in FIG. 9, the discharge hole 16 is positioned at an antinode, and thus the dip 42 occurs, leading to decreased amount of noise reduction. This results in reduced silencing effect of the silencing chamber 33 according to Comparative Example. That is, when acoustic resonance modes each exhibiting a sound pressure distribution with a single node occur consecutively, this results in the discharge hole 16 being positioned at an antinode in one of the two consecutive acoustic resonance modes. This causes the dip 42 to occur, leading to decreased amount of noise reduction.

In the silencing chamber 15 according to Embodiment 1, by contrast, three acoustic resonance modes occur as illustrated in FIGS. 11 to 13. FIG. 11 depicts an acoustic resonance mode that occurs at a frequency below the frequency band 41, and that has a sound pressure distribution with a single node in the radial direction. FIG. 12 depicts an acoustic resonance mode that occurs at a frequency within the frequency band 41, and that has a sound pressure distribution with two nodes in the radial direction. FIG. 13 depicts an acoustic resonance mode that occurs at a frequency within the frequency band 41, and that has a sound pressure distribution with a single node in the radial direction.

In the silencing chamber 15, the following acoustic resonance modes occur in sequence: the acoustic resonance mode with a sound pressure distribution having a single node in the radial direction (FIG. 11); the acoustic resonance mode with a sound pressure distribution having two nodes in the radial direction (FIG. 12); and the acoustic resonance mode with a sound pressure distribution having a single node in the radial direction (FIG. 13). As described above, in the silencing chamber 15 according to Embodiment 1, acoustic resonance modes each exhibiting a sound pressure distribution with a single node do not occur consecutively. This is because the expansion part 17 has a flattened cross-sectional shape, and thus the sound field formed by the expansion part 17 has rotation asymmetry.

For the configuration in which the discharge hole 16 is positioned at a node of the sound pressure distribution of an acoustic resonance mode having two nodes in the radial direction, as illustrated in FIGS. 12 and 13, acoustic resonance modes occurred consecutively that each have a sound pressure distribution with a node positioned at the discharge hole 16. Consequently, as illustrated in FIG. 8, the amount of noise reduction provided by the silencing chamber 15 can be maintained positive over the wide frequency band 41, leading to increased silencing effect. That is, due to the expansion part 17 of the silencing chamber 33 being formed in a flattened shape as seen in the axial direction, the scroll compressor 100 allows for reduced jet noise resulting from pressure pulsations.

Reference is now made to the effect of positioning the expansion part 17 in such a way that satisfies the condition that 45 degrees≤θ≤135 degrees.

Figure 14:
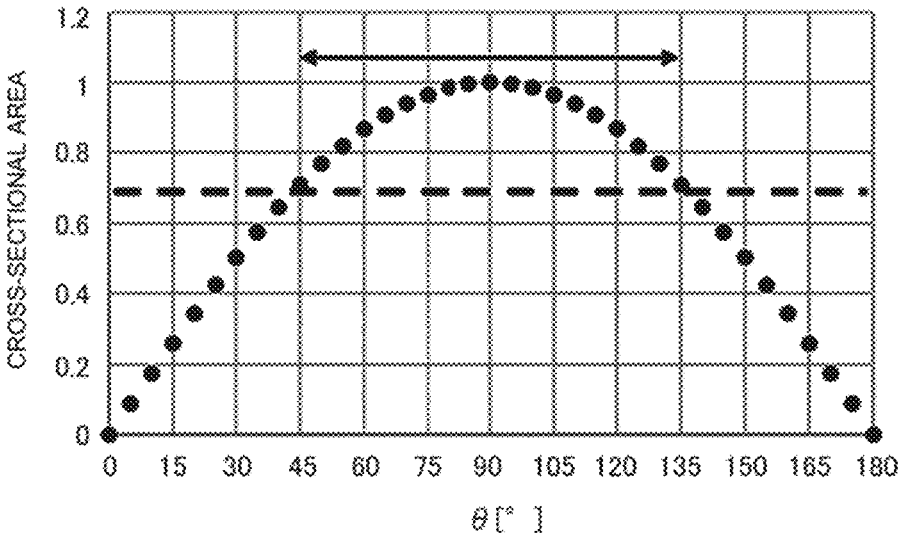
FIG. 14 is a graph related to the positioning of the expansion part of the silencing chamber according to Embodiment 1, illustrating how the cross-sectional area of the expansion part changes as an angle θ is changed in increments of 5 degrees within a range of 0 degrees to 180 degrees.

FIG. 14 is a graph related to the positioning of the expansion part 17 of the silencing chamber 15 according to Embodiment 1, illustrating how the cross-sectional area of the expansion part 17 changes as the angle θ is changed in increments of 5 degrees within a range of 0 degrees to 180 degrees. The horizontal axis represents the angle @ [degrees]. The vertical axis represents the cross-sectional area normalized by the cross-sectional area when the angle θ is 90 degrees representing the maximum cross-sectional area. The cross-sectional area along the vertical axis is calculated based on a relational expression in which the expansion part 17 has a fixed length in the direction of the major axis, and has a length in the direction of the minor axis that changes with changes in the angle θ.

As described above, the cross-sectional area of the expansion part 17 changes with changes in the angle θ. This is due to the reason described below. The expansion part 17 is necessarily required to be positioned between two chamber sub-ports 18. Although it is possible to cause the expansion part 17 to rotate while keeping the same cross-sectional area, eventually an angle is reached where the expansion part 17 comes into interference with the two chamber sub-ports 18. At this time, if the length of the expansion part 17 in the major-axis direction is fixed to maintain a high degree of flattening, reducing the length of the expansion part 17 in the minor-axis direction allows the expansion part 17 to be positioned between the two chamber sub-ports 18 in the scroll compressor 100. That is, if the angle θ is within a range that satisfies the condition that 45 degrees≤θ≤135 degrees, reducing the length of the expansion part 17 in the minor-axis direction allows the expansion part 17 to be positioned between the two chamber sub-ports 18 in the scroll compressor 100. This makes it possible to prevent a decrease in the amount of noise reduction. Although the expansion part 17 may be caused to rotate while maintaining the same cross-sectional area, in that case, the expansion part 17 needs to be positioned to avoid interference with the two chamber sub-ports 18.

It is appreciated from FIG. 14 that when the angle @ satisfies the condition that 45 degrees≤θ≤135 degrees, the cross-sectional area of the expansion part 17 is greater than or equal to 70% of the maximum cross-sectional area. The silencing effect of a silencer increases with increasing cross-sectional area of the expansion part relative to the cross-sectional area of the input face. Accordingly, designing the expansion part 17 within the angular range mentioned above makes it possible to prevent a decrease in the amount of noise reduction.

Reference is now made to the effect of making the aspect ratio between the major and minor axes of the flattened shape 101 of the expansion part 17 greater than or equal to 5:1.

When the aspect ratio between the major and minor axes of the flattened shape 101 of the expansion part 17 is greater than or equal to 5:1, the separation between acoustic resonance modes with the same sound pressure distribution can be increased for the reason described below. Increased separation between acoustic resonance modes means that the respective frequencies at which these acoustic resonance modes occur are far apart from each other.

A flattening e, which is a numerical value representing the degree of flattening of a flattened shape, is given by Equation (2) below.

[Math. 2]

$$e = 1 - b/a \tag{2}$$

In Equation (2), "a" denotes the radius of the major axis, and "b" denotes the radius of the minor axis. The closer the value of the flattening e is to 1, the greater the degree of flattening. A low degree of flattening causes the above-mentioned separation between acoustic resonance modes to decrease, with the result that acoustic resonance modes with the same sound pressure distribution occur at frequencies very close to each other. A high degree of flattening, by contrast, allows the above-mentioned separation between acoustic resonance modes to be increased.

In this regard, an aspect ratio of greater than or equal to 5:1 translates to a flattening e of greater than or equal to 0.8. This means that the degree of flattening is greater than 0.5, which is the middle value of flattening. Therefore, an aspect ratio of greater than or equal to 5:1 allows for increased separation between acoustic resonance modes having the same sound pressure distribution. Specifically, the frequency separation between acoustic resonance modes with the same sound pressure distribution is greater than or equal to 1×kHz. As described above, increasing the degree of flattening allows for increased separation between acoustic resonance modes with the same sound pressure distribution. This allows the amount of noise reduction to be maintained positive over the wide frequency band 41, leading to increased silencing effect.

A decrease in the cross-sectional area of the discharge hole 16 results in a decrease in the flow rate of working gas passing through the interior of the silencing chamber 15. This leads to decreased efficiency. In this regard, setting the angle θ within the range mentioned above allows the expansion part 17 to have a relatively large cross-sectional area. The above-mentioned configuration therefore makes it possible to reduce jet noise resulting from pressure pulsations while maintaining efficiency, without requiring a decrease in the cross-sectional area of the discharge hole 16.

As described above, the scroll compressor 100 according to Embodiment 1 is the scroll compressor 100 of a multi-port type including the main port 19 and the sub-ports 20, with the expansion part 17 of the silencing chamber 15 having a flattened shape as seen in the axial direction. The sound field formed by the expansion part 17 thus has rotational asymmetry, which ensures frequency separation between acoustic resonance modes having the same sound pressure distribution and whose node and antinode locations have a 90-degree phase shift relative to each other. This helps to prevent an antinode of an acoustic resonance mode from being positioned at the discharge hole 16 of the silencing chamber 15, and consequently to mitigate a decrease in silencing effect. As a result, noise resulting from refrigerant pulsations in the scroll compressor 100 of a multi-port type can be reduced.

In the scroll compressor 100, as seen in the axial direction, the rectangle 102 circumscribing the flattened shape has a length in the longitudinal direction that is greater than the shortest distance between two chamber sub-ports 18. As a result, the degree of flattening of the expansion part 17 can be increased to increase the separation between acoustic resonance modes. This makes it possible to prevent a decrease in the amount of noise reduction in the scroll compressor 100.

As described above, as seen in the axial direction, the main port 19 and the discharge hole 16 lie on the central axis 105 in the transverse direction of the rectangle 102. This makes it possible to position the discharge hole 16 at a node of an acoustic resonance mode that occurs in the expansion part 17, and consequently to prevent a decrease in the amount of noise reduction in the scroll compressor 100.

As seen in the axial direction, the longitudinal direction of the rectangle circumscribing the flattened shape of the expansion part 17, and the straight line connecting the respective centers of two chamber sub-ports 18 form the angle θ that satisfies the condition that 45 degrees≤θ≤135 degrees. This makes it possible to prevent a decrease in the amount of noise reduction in the scroll compressor 100.

Embodiment 2

Structure of Embodiment 2

Embodiment 2 differs from Embodiment 1 in the cross-sectional shape of the expansion part of the silencing chamber. Embodiment 2 is described below with focus on features different from those according to Embodiment 1, and features not described with reference to Embodiment 2 below are similar or identical to those according to Embodiment 1.

Figure 15:
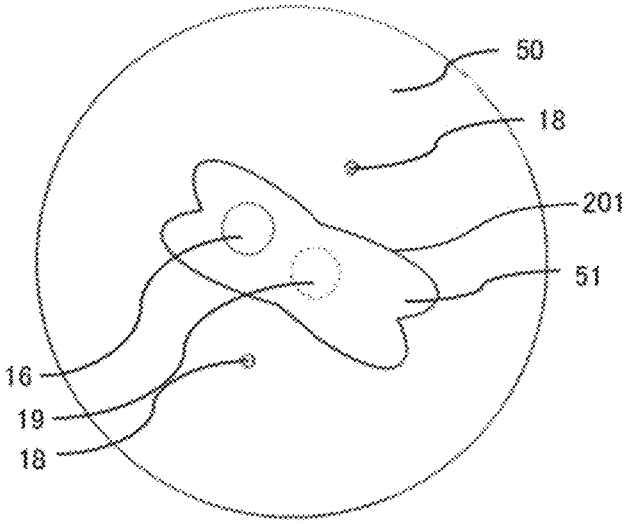
FIG. 15 is a plan view, as seen in the axial direction from the fixed scroll, of a silencing chamber according to Embodiment 2.
Figure 16:
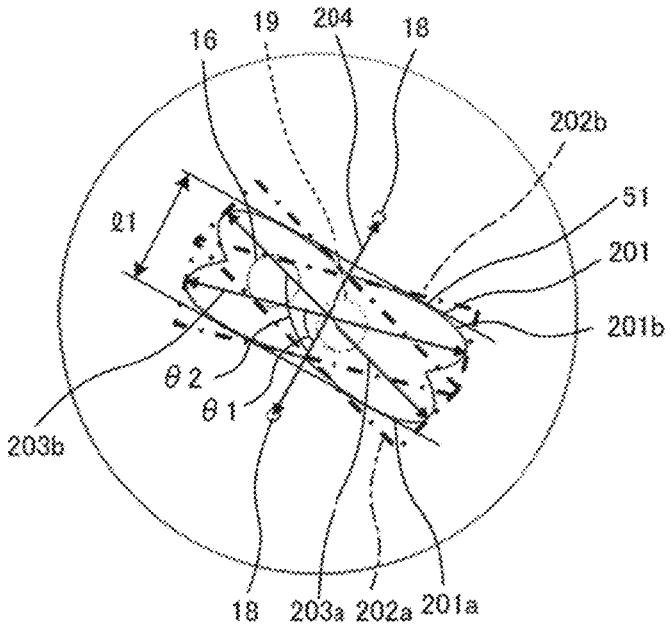
FIG. 16 is an illustration for explaining how the shape of an expansion part of the silencing chamber according to Embodiment 2 is defined.

FIG. 15 is a plan view, as seen in the axial direction from the fixed scroll 7, of a silencing chamber 50 according to Embodiment 2. FIG. 16 is an illustration for explaining how the shape of an expansion part 51 of the silencing chamber 50 according to Embodiment 2 is defined.

The expansion part 51 of the silencing chamber 50 according to Embodiment 2 has a flattened shape 201 as seen in the axial direction. The flattened shape 201 is obtained by connecting the outlines of two flattened shapes positioned to partially overlap each other. Although FIG. 16 depicts an example in which one of the two flattened shapes constituting the flattened shape 201 is positioned such that the one flattened shape is rotated relative to the other flattened shape about the center of the other flattened shape, this is not to be construed restrictively. In another example, one of the two flattened shapes constituting the flattened shape 201 may be positioned such that the one flattened shape is a translation of the other flattened shape. Although the flattened shape 201 is depicted in the example in FIG. 16 as being made up of two flattened shapes, the flattened shape 201 may be made up of three or more flattened shapes. In short, the flattened shape 201 may be any shape obtained by connecting the outlines of a plurality of flattened shapes positioned to partially overlap each other. The following describes how the shape of the expansion part 51 is defined for an example in which the flattened shape is made up of two flattened shapes. Of the two flattened shapes, one is referred to as a flattened shape 201*a*, and the other is referred to as a flattened shape 201*b*.

The flattened shape 201*a* is positioned such that a longitudinal direction 203*a* of a rectangle 202*a* circumscribing the flattened shape 201*a*, and a straight line 204 connecting the respective centers of the chamber sub-ports 18 form an angle θ1 that satisfies the condition that 45 degrees≤θ1≤135 degrees. The flattened shape 201*b* is positioned such that a longitudinal direction 203*b* of a rectangle 202*b* circumscribing the flattened shape 201*b*, and the straight line 204 connecting the respective centers of the chamber sub-ports 18 form an angle θ2 that satisfies the condition that 45 degrees≤θ2≤135 degrees. The minor axis of the flattened shape 201 has a length l1 less than the shortest distance between two chamber sub-ports 18. The length l1 of the minor axis of the flattened shape 201 is the length in the transverse direction of the rectangle circumscribing the flattened shape 201. The main port 19 and the discharge hole 16 lie on a central axis that divides one of the rectangle 202*a* and the rectangle 202*b* in two in the transverse direction.

Operation and Effects According to Embodiment 2

Figure 17:
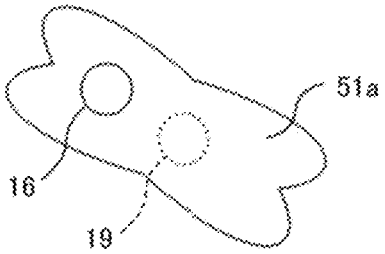
FIG. 17 illustrates an acoustic analysis model that is an extraction of the expansion part of the silencing chamber according to Embodiment 2.

FIG. 17 illustrates an acoustic analysis model 51*a* that is an extraction of the expansion part 51 of the silencing chamber 50 according to Embodiment 2. The expansion part 51 has a cross-sectional area equal to the cross-sectional area of the expansion part 17 according to Embodiment 1. The acoustic analysis model 51*a* is a model in which the expansion part 51 of the silencing chamber 50 is filled with finite elements, and in which the main port 19 serves as an input face and the discharge hole 16 serves as an outlet face. An acoustic analysis was conducted using the acoustic analysis model 51*a*. The analysis was conducted using the following conditions: a particle velocity of 1 [m/s] was given to the input face; air was used as fluid: the acoustic velocity c was 340 [m/s]; and the air density r was 1.225 [kg/m$^3$]. The amount of noise reduction NR was calculated by substitution of the sound pressure level $L_{p1}$ at the input face and the sound pressure level $L_{p2}$ at the outlet face into Equation (1) mentioned above.

Figure 18:
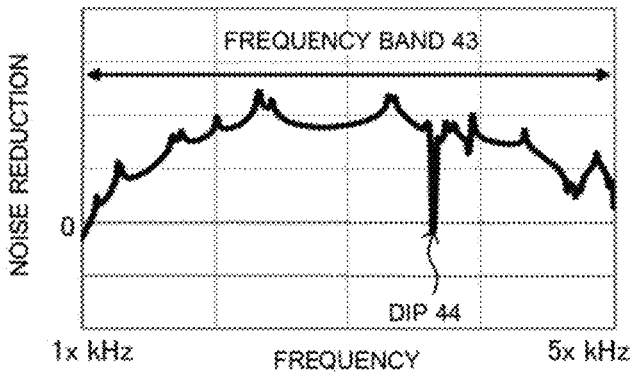
FIG. 18 is a graph representing the characteristics of the acoustic analysis results on the expansion part of the silencing chamber according to Embodiment 2, illustrating the amount of noise reduction with respect to frequency.

FIG. 18 is a graph representing the characteristics of the acoustic analysis results on the expansion part 51 of the silencing chamber 50 according to Embodiment 2, illustrating the amount of noise reduction with respect to frequency. As illustrated in FIG. 18, the amount of noise reduction in the expansion part 51 is positive within a frequency band 43. That is, Embodiment 2 provides a silencing effect over the frequency band 43, which covers a wide range of frequencies. A dip 44 is observed to occur in FIG. 18. The dip 44 will be described later.

FIGS. 19 to 22 each conceptually illustrate the sound pressure distribution of an acoustic resonance mode in the expansion part 51 of the silencing chamber 50 according to Embodiment 2. In FIGS. 19 to 22, "+" and "−" represent antinodes of acoustic resonance modes, and thin lines represent nodes.

Figure 19:
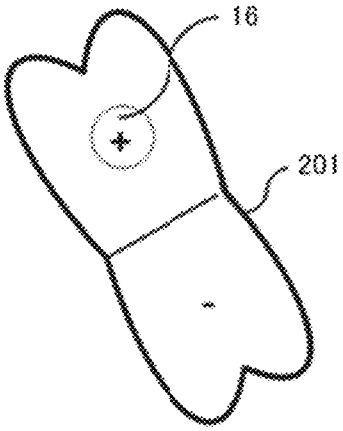
FIG. 19 conceptually illustrates the sound pressure distribution of an acoustic resonance mode in the expansion part of the silencing chamber according to Embodiment 2.
Figure 20:
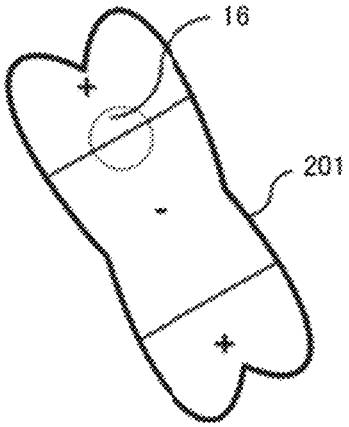
FIG. 20 conceptually illustrates the sound pressure distribution of an acoustic resonance mode in the expansion part of the silencing chamber according to Embodiment 2.
Figure 21:
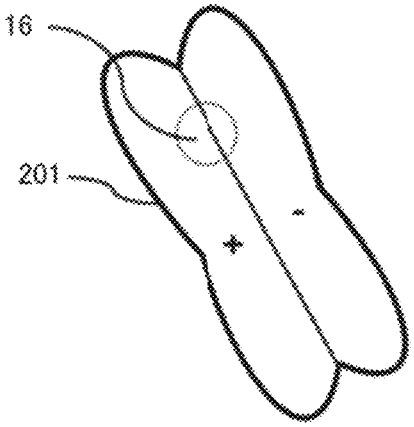
FIG. 21 conceptually illustrates the sound pressure distribution of an acoustic resonance mode in the expansion part of the silencing chamber according to Embodiment 2.
Figure 22:
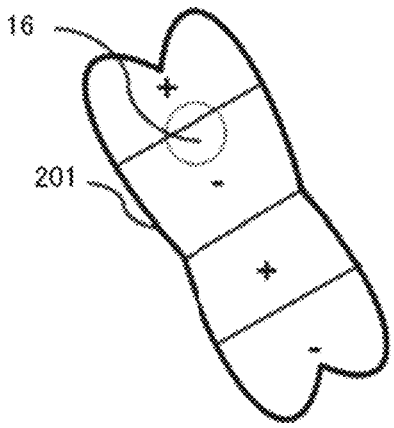
FIG. 22 conceptually illustrates the sound pressure distribution of an acoustic resonance mode in the expansion part of the silencing chamber according to Embodiment 2.

It is confirmed from the simulation results that in the silencing chamber 50 according to Embodiment 2, four acoustic resonance modes illustrated in FIGS. 19 to 22 occur in the expansion part 51. FIG. 19 depicts an acoustic resonance mode that occurs at a frequency below the frequency band 43, and that has a sound pressure distribution with a single node in the radial direction. FIG. 20 depicts an acoustic resonance mode that occurs at a frequency within the frequency band 43, and that has a sound pressure distribution with two nodes in the radial direction. FIG. 21 depicts an acoustic resonance mode that occurs at a frequency within the frequency band 43, and that has a sound pressure distribution with a single node in the radial direction. FIG. 22 depicts an acoustic resonance mode that occurs at a frequency within the frequency band 43, and that has a sound pressure distribution with three nodes in the radial direction.

In the silencing chamber 50, the following acoustic resonance modes occur in sequence: the acoustic resonance mode illustrated in FIG. 19 that has a sound pressure distribution with a single node in the radial direction; the acoustic resonance mode illustrated in FIG. 20 that has a sound pressure distribution with two nodes in the radial direction; the acoustic resonance mode illustrated in FIG. 21 that has a sound pressure distribution with a single node in the radial direction; and the acoustic resonance mode illustrated in FIG. 22 that has a sound pressure distribution with three nodes in the radial direction. As described above, in the silencing chamber 50, acoustic resonance modes each exhibiting a sound pressure distribution with a single node in the radial direction, that is, the sound pressure distribution illustrated in FIG. 19 and the sound pressure distribution illustrated in FIG. 21, do not occur consecutively. This makes it possible to mitigate a decrease in the amount of noise reduction in the silencing chamber 50. The reason why sound pressure distributions each having a single node in the radial direction do not occur consecutively is that the expansion part 51 has a flattened shape and thus the sound field formed by the expansion part 51 has rotational asymmetry.

With regard to the configuration in which the discharge hole 16 is positioned at a node of the sound pressure distribution of an acoustic resonance mode having two nodes in the radial direction, acoustic resonance modes each having a sound pressure distribution with a node positioned at the discharge hole 16 occurred consecutively as illustrated in FIGS. 20 to 22. Consequently, as illustrated in FIG. 18, the amount of noise reduction provided by the silencing chamber 50 can be maintained positive over the wide frequency band 43, leading to increased silencing effect. That is, due to the expansion part 51 of the silencing chamber 50 being formed in a flattened shape as seen in the axial direction, the scroll compressor 100 allows for reduced jet noise resulting from pressure pulsations.

Although the silencing chamber 50 provides a significant silencing effect, the expansion part 51 exhibits the dip 44 due to the presence of an acoustic resonance mode with a sound pressure distribution having three nodes in the radial direction. This is because the discharge hole 16 is displaced relative to the corresponding node in the acoustic resonance mode illustrated in FIG. 22. Specifically, the central portion of the discharge hole 16 is displaced relative to the corresponding node.

In the silencing chamber 50, the expansion part 51 exhibits the dip 44 as described above. In this regard, the dip 44 occurs in a sound pressure distribution when the sound pressure distribution has three nodes in the radial direction. In the case of an acoustic resonance mode having a sound pressure distribution with three nodes in the radial direction, that is, the sound pressure distribution illustrated in FIG. 22, a decrease in the amount of noise reduction occurs over a narrow frequency band, unlike with a mode in which the major part of the discharge hole 16 is positioned at an antinode of the sound pressure distribution as in the case of the acoustic resonance mode having the sound pressure distribution illustrated in FIG. 19. Accordingly, the dip 44 resulting from the acoustic resonance mode with a sound pressure distribution having three nodes in the radial direction can be reduced by means of the silencing muffler 14 located downstream of the silencing chamber 50 with respect to the flow of refrigerant.

As described above, the scroll compressor 100 according to Embodiment 2 can provide effects similar to those provided by Embodiment 1.

Embodiment 3

Structure of Embodiment 3

Embodiment 3 differs from Embodiment 1 in the shape of the expansion part of the silencing chamber. Embodiment 3 is described below with focus on features different from those according to Embodiment 1, and features not described with reference to Embodiment 3 below are similar or identical to those according to Embodiment 1.

Figure 23:
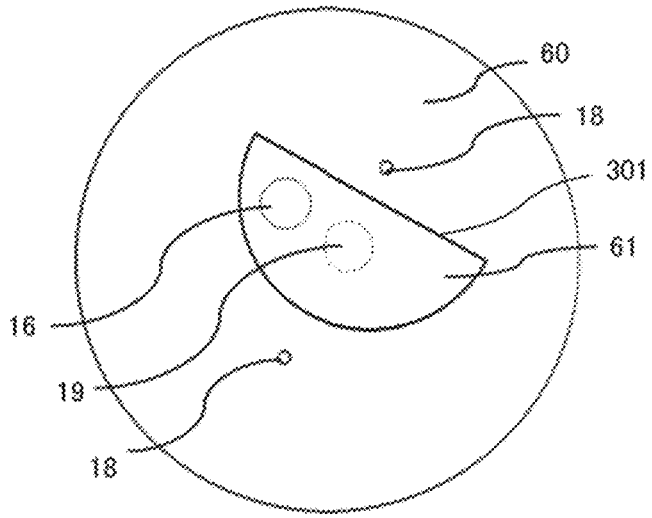
FIG. 23 is a plan view, as seen in the axial direction from the fixed scroll, of a silencing chamber according to Embodiment 3.
Figure 24:
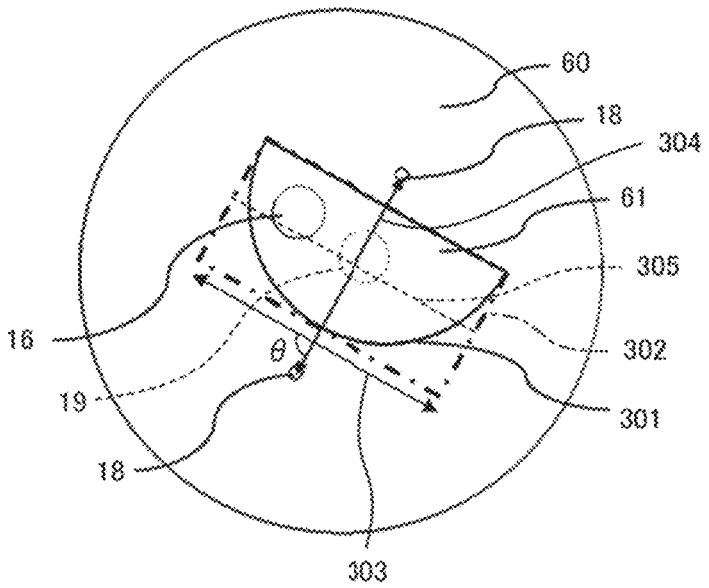
FIG. 24 is an illustration for explaining how the shape of an expansion part of the silencing chamber according to Embodiment 3 is defined.

FIG. 23 is a plan view, as seen in the axial direction from the fixed scroll 7, of a silencing chamber 60 according to Embodiment 3. FIG. 24 is an illustration for explaining how the shape of an expansion part 61 of the silencing chamber 60 according to Embodiment 3 is defined.

The expansion part 61 of the silencing chamber 60 according to Embodiment 3 has a flattened shape 301 as seen in the axial direction. As illustrated in FIG. 24, as seen in the axial direction, the expansion part has two parts including one part and an other part, the one part having a cross-sectional area greater than a cross-sectional area of the other part, the two parts are formed by dividing the expansion part by a central axis that is a central axis in a transverse direction of a rectangle circumscribing the flattened shape. In one example, the flattened shape 301 is a shape obtained by connecting the opposite ends of an arc by a straight line as illustrated in FIGS. 23 and 24. The flattened shape 301 is positioned such that a longitudinal direction 303 of the rectangle 302 circumscribing the flattened shape 301, and a straight line 304 connecting the respective centers of the chamber sub-ports 18 form an angle θ that satisfies the condition that 45 degrees≤θ≤135 degrees. The main port 19 and the discharge hole 16 lie on the central axis 305.

Operation and Effects According to Embodiment 3

Figure 25:
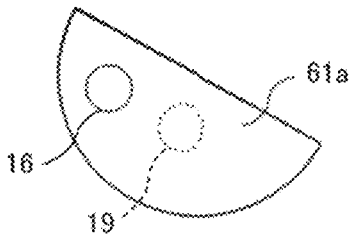
FIG. 25 illustrates an acoustic analysis model that is an extraction of the expansion part of the silencing chamber according to Embodiment 3.

FIG. 25 illustrates an acoustic analysis model 61*a* that is an extraction of the expansion part 61 of the silencing chamber 60 according to Embodiment 3. The expansion part 61 has a cross-sectional area equal to the cross-sectional area of the expansion part 17 according to Embodiment 1. The acoustic analysis model 61*a* is a model in which the expansion part 61 of the silencing chamber 60 is filled with finite elements, and in which the main port 19 serves as an input face and the discharge hole 16 serves as an outlet face. An acoustic analysis was conducted using the acoustic analysis model 61*a*. The analysis was conducted using the following conditions: a particle velocity of 1 [m/s] was given to the input face; air was used as fluid: the acoustic velocity c was 340 [m/s]; and the air density r was 1.225 [kg/m$^3$]. The amount of noise reduction NR was calculated by substitution of the sound pressure level $L_{p1}$ at the input face and the sound pressure level $L_{p2}$ at the outlet face into Equation (1) mentioned above.

Figure 26:
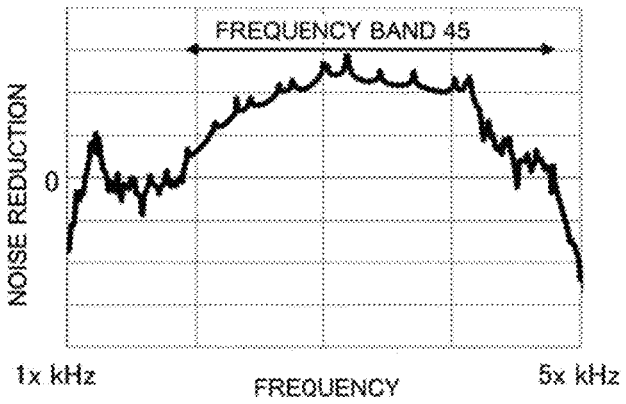
FIG. 26 is a graph representing the characteristics of the acoustic analysis results on the expansion part 61 of the silencing chamber 60 according to Embodiment 3, illustrating the amount of noise reduction with respect to frequency.

FIG. 26 is a graph representing the characteristics of the acoustic analysis results on the expansion part 61 of the silencing chamber 60 according to Embodiment 3, illustrating the amount of noise reduction with respect to frequency. As illustrated in FIG. 26, the amount of noise reduction in the expansion part 61 is positive within a frequency band 45. That is, Embodiment 3 provides a silencing effect over the frequency band 45, which covers a wide range of frequencies.

Figure 27:
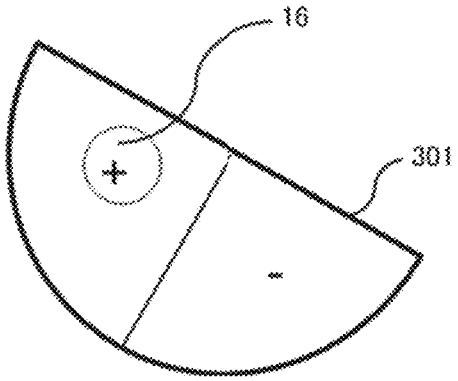
FIG. 27 conceptually illustrates the sound pressure distribution of an acoustic resonance mode in the expansion part of the silencing chamber according to Embodiment 3.
Figure 28:
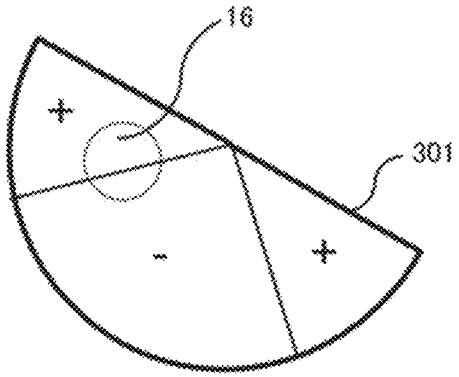
FIG. 28 conceptually illustrates the sound pressure distribution of an acoustic resonance mode in the expansion part of the silencing chamber according to Embodiment 3.
Figure 29:
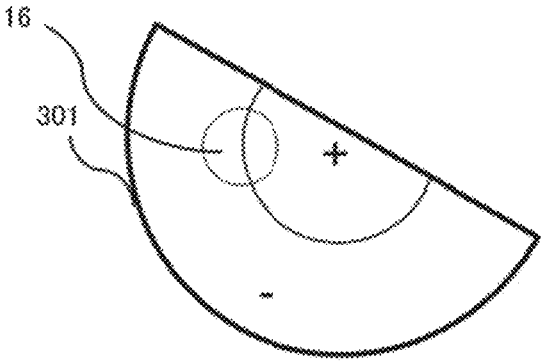
FIG. 29 conceptually illustrates the sound pressure distribution of an acoustic resonance mode in the expansion part of the silencing chamber according to Embodiment 3.

FIGS. 27 to 29 each conceptually illustrate the sound pressure distribution of an acoustic resonance mode in the expansion part 61 of the silencing chamber 60 according to Embodiment 3. In FIGS. 27 to 29, "+" and "−" represent antinodes of acoustic resonance modes, and thin lines represent nodes.

It is confirmed from the simulation results that in the silencing chamber 60 according to Embodiment 3, three acoustic resonance modes occur in the expansion part 61 as illustrated in FIGS. 27 to 29. FIG. 27 depicts an acoustic resonance mode that occurs at a frequency below the frequency band 45, and that has a sound pressure distribution with a single node in the radial direction. FIG. 28 depicts an acoustic resonance mode that occurs at a frequency within the frequency band 45, and that has a sound pressure distribution with two nodes in the radial direction. FIG. 29 depicts an acoustic resonance mode that occurs at a frequency within the frequency band 45, and that has a sound pressure distribution with a single node in the circumferential direction. As used herein, the term "circumferential direction" representing the direction of a node refers to a direction along the outer circumference of an acoustic resonance mode.

In the silencing chamber 60, the three acoustic resonance modes illustrated in FIGS. 27 to 29 occur. No acoustic resonance mode occurs that exhibits a sound pressure distribution with a 90-degree phase shift relative to the sound pressure distribution of the acoustic resonance mode with a single node in the radial direction illustrated in FIG. 27. Consequently, an acoustic resonance mode having a sound pressure distribution with an antinode positioned at the discharge hole 16, and an acoustic resonance mode having a sound pressure distribution with a node positioned at the discharge hole 16 do not occur at frequencies very close to each other. As a result, a decrease in silencing effect does not occur in the silencing chamber 60. The reason why no acoustic resonance mode occurs that exhibits a sound pressure distribution with a 90-degree phase shift relative to the sound pressure distribution of the acoustic resonance mode with a single node in the radial direction illustrated in FIG. 27 is that the sound field formed by the expansion part 61 has rotational asymmetry, and has asymmetry about the central axis 305 of the rectangle 302.

With regard to the configuration in which the discharge hole 16 is positioned at a node of the sound pressure distribution of an acoustic resonance mode with two nodes in the radial direction, acoustic resonance modes each having a sound pressure distribution with a node positioned at the discharge hole 16 occurred consecutively as illustrated in FIGS. 28 and 29. This means that, due to the expansion part 61 being formed in a flattened shape as seen in the axial direction, the amount of noise reduction provided by the silencing chamber 60 can be maintained positive over the wide frequency band 45 as illustrated in FIG. 26, leading to increased silencing effect. That is, due to the expansion part 61 of the silencing chamber 60 being formed in a flattened shape as seen in the axial direction, the scroll compressor 100 allows for reduced jet noise resulting from pressure pulsations.

As described above, the scroll compressor 100 according to Embodiment 3 can provide effects similar to those provided by Embodiment 1.

Embodiment 4

Structure of Embodiment 4

Embodiment 4 differs from Embodiment 1 in the cross-sectional shape of the expansion part of the silencing chamber. Embodiment 4 is described below with focus on features different from those according to Embodiment 1, and features not described with reference to Embodiment 4 below are similar or identical to those according to Embodiment 1.

Figure 30:
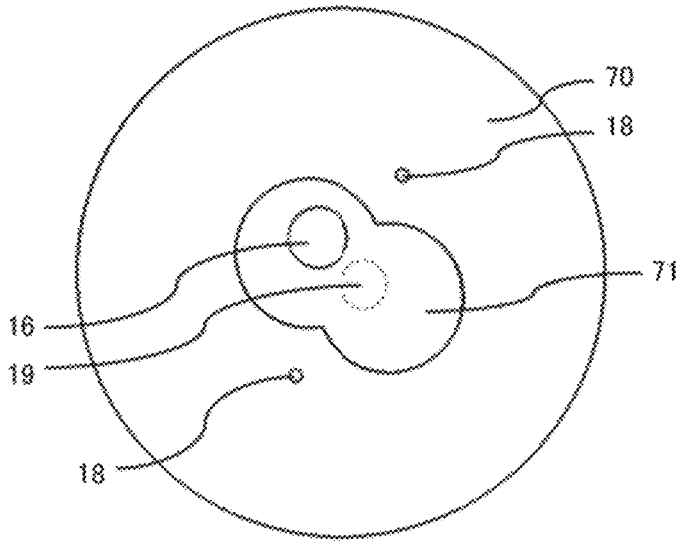
FIG. 30 is a plan view, as seen in the axial direction from the fixed scroll, of a silencing chamber according to Embodiment 4.
Figure 31:
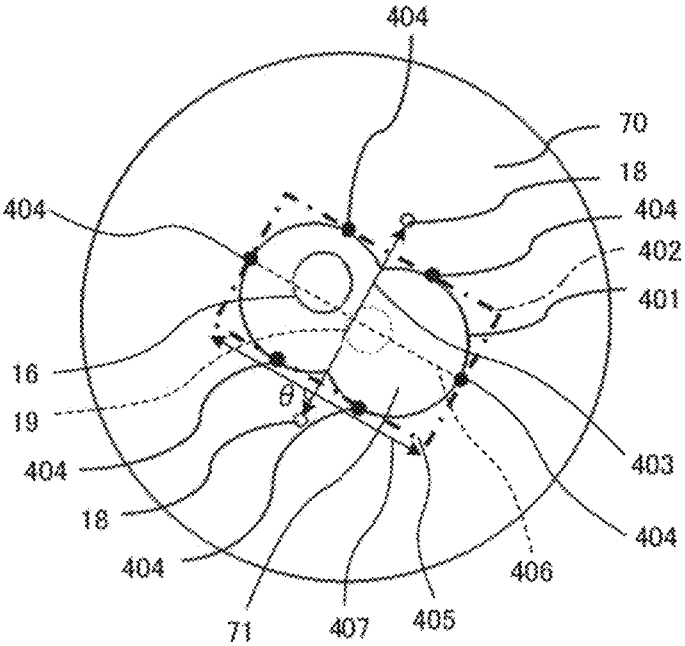
FIG. 31 is an illustration for explaining how the shape of an expansion part of the silencing chamber according to Embodiment 4 is defined.

FIG. 30 is a plan view, as seen in the axial direction from the fixed scroll 7, of a silencing chamber 70 according to Embodiment 4. FIG. 31 is an illustration for explaining how the shape of an expansion part 71 of the silencing chamber 70 according to Embodiment 4 is defined.

The expansion part 71 of the silencing chamber 70 according to Embodiment 4 has a flattened shape 401 as seen in the axial direction. More specifically, as illustrated in FIG. 31, the flattened shape 401 is a shape that, as seen in the axial direction, is inscribed in a rectangle 402, and has a plurality of points of contact 404 with the four sides of the rectangle 402. The flattened shape 401 has two or more points of contact 404 with at least one side 405 of the rectangle 402. FIGS. 30 and 31 each illustrate an example in which the flattened shape 401 has two points of contact 404 with each of two opposite sides of the rectangle. The flattened shape 401 is positioned such that a longitudinal direction 407 of the rectangle 402 circumscribing the flattened shape 401, and a straight line 403 connecting the respective centers of the chamber sub-ports 18 form an angle θ that satisfies the condition that 45 degrees≤θ≤135 degrees. The main port 19 and the discharge hole 16 lie on a central axis 406 that divides the rectangle 402 in two in the transverse direction.

Operation and Effects According to Embodiment 4

Figure 32:
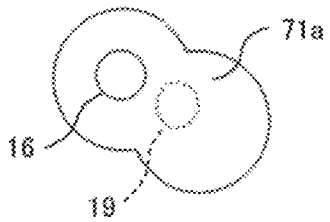
FIG. 32 illustrates an acoustic analysis model that is an extraction of the expansion part of the silencing chamber according to Embodiment 4.

FIG. 32 illustrates an acoustic analysis model 71*a* that is an extraction of the expansion part 71 of the silencing chamber 70 according to Embodiment 4. The expansion part 71 has a cross-sectional area equal to the cross-sectional area of the expansion part 17 according to Embodiment 1. For the acoustic analysis model 71*a*, an acoustic analysis was conducted with the expansion part 71 of the silencing chamber 70 filled with finite elements, with the main port 19 serving as an input face and the discharge hole 16 serving as an outlet face. The analysis was conducted using the following conditions: a particle velocity of 1 [m/s] was given to the input face; air was used as fluid: the acoustic velocity c was 340 [m/s]; and the air density r was 1.225 [kg/m$^3$]. The amount of noise reduction NR was calculated by substitution of the sound pressure level $L_{p1}$ at the input face and the sound pressure level $L_{p2}$ at the outlet face into Equation (1) mentioned above.

Figure 33:
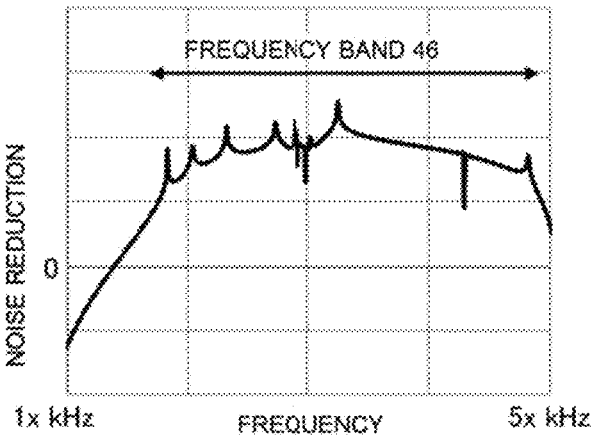
FIG. 33 is a graph illustrating the characteristics of the acoustic analysis results for the expansion part of the silencing chamber according to Embodiment 4, illustrating the amount of noise reduction with respect to frequency.

FIG. 33 is a graph representing the characteristics of the acoustic analysis results on the expansion part 71 of the silencing chamber 70 according to Embodiment 4, illustrating the amount of noise reduction with respect to frequency. As illustrated in FIG. 33, the amount of noise reduction in the expansion part 71 is positive within a frequency band 46. That is, Embodiment 4 provides a silencing effect over the frequency band 46, which covers a wide range of frequencies.

FIGS. 34 to 37 each conceptually illustrate the sound pressure distribution of an acoustic resonance mode in the expansion part of the silencing chamber according to Embodiment 4. In FIGS. 34 to 37, "+" and "−" represent antinodes of acoustic resonance modes, and thin lines represent nodes.

Figure 34:
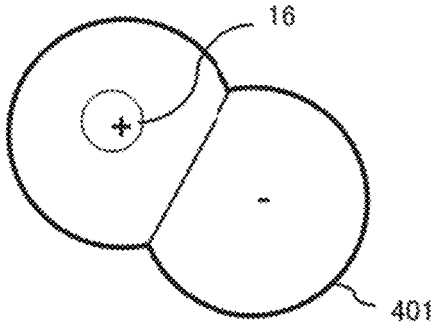
FIG. 34 conceptually illustrates the sound pressure distribution of an acoustic resonance mode in the expansion part of the silencing chamber according to Embodiment 4.
Figure 35:
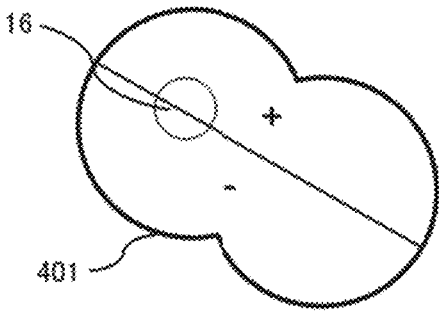
FIG. 35 conceptually illustrates the sound pressure distribution of an acoustic resonance mode in the expansion part of the silencing chamber according to Embodiment 4.
Figure 36:
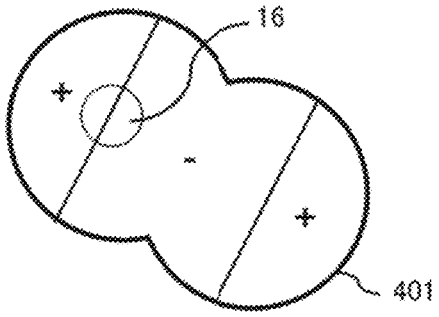
FIG. 36 conceptually illustrates the sound pressure distribution of an acoustic resonance mode in the expansion part of the silencing chamber according to Embodiment 4.
Figure 37:
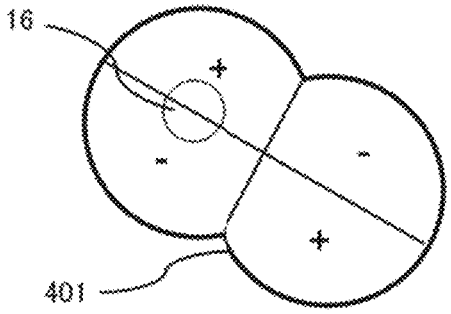
FIG. 37 conceptually illustrates the sound pressure distribution of an acoustic resonance mode in the expansion part of the silencing chamber according to Embodiment 4.

In the silencing chamber 70 according to Embodiment 4, four acoustic resonance modes occur as illustrated in FIGS. 34 to 37. FIG. 34 depicts an acoustic resonance mode that occurs at a frequency below the frequency band 46, and that has a sound pressure distribution with a single node in the radial direction. FIG. 35 depicts an acoustic resonance mode that occurs at a frequency below the frequency band 46, and that has a sound pressure distribution with a single node in the radial direction. FIG. 36 depicts an acoustic resonance mode that occurs at a frequency within the frequency band 46, and that has a sound pressure distribution with two nodes in the radial direction. FIG. 37 depicts an acoustic resonance mode that occurs at a frequency within the frequency band 46, and that has a sound pressure distribution with two nodes in the radial direction.

In the silencing chamber 70, the following acoustic resonance modes occur in sequence: the acoustic resonance mode illustrated in FIG. 34 that has a sound pressure distribution with a single node in the radial direction; the acoustic resonance mode illustrated in FIG. 35 that has a sound pressure distribution with a single node in the radial direction; the acoustic resonance mode illustrated in FIG. 36 that has a sound pressure distribution with two nodes in the radial direction; and the acoustic resonance mode illustrated in FIG. 37 that has a sound pressure distribution with two nodes in the radial direction. This means that in the silencing chamber 70, the following acoustic resonance modes occur consecutively: the acoustic resonance mode illustrated in FIG. 34, which has a single node; and the acoustic resonance mode illustrated in FIG. 35, which has a single node and which exhibits the same sound pressure distribution with a 90-degree phase shift relative to the acoustic resonance mode illustrated in FIG. 34. It is observed from the results of a simulation, however, that the acoustic resonance mode illustrated in FIG. 34, and the acoustic resonance mode illustrated in FIG. 35 occur with a frequency separation from each other of greater than or equal to 1×kHz. This makes it possible to mitigate a decrease in the amount of noise reduction. The reason why these acoustic resonance modes occur with a frequency separation from each other of greater than or equal to 1×KHz is that the sound field formed by the expansion part 71 has rotational asymmetry.

With regard to the configuration in which the discharge hole 16 is positioned at the same node of acoustic resonance modes, that is, at a node of the sound pressure distribution of an acoustic resonance mode having a single node in the radial direction, and at a node of the sound pressure distribution of an acoustic resonance mode having two nodes in the radial direction, acoustic resonance modes each having a sound pressure distribution with a node positioned at the discharge hole 16 occurred consecutively as illustrated in FIGS. 35 to 37. Accordingly, due to the expansion part 71 being formed in a flattened shape as seen in the axial direction, the amount of noise reduction provided by the silencing chamber 70 can be maintained positive over the wide frequency band 46 as illustrated in FIG. 34, leading to increased silencing effect. That is, due to the expansion part 71 of the silencing chamber 70 being formed in a flattened shape as seen in the axial direction, the scroll compressor 100 allows for reduced jet noise resulting from pressure pulsations.

As described above, the scroll compressor 100 according to Embodiment 4 can provide effects similar to those provided by Embodiment 1.

REFERENCE SIGNS LIST

1: shell, 1*a*: lower shell, 1*b*: mid-shell, 1*c*: upper shell, 2: suction pipe, 3: discharge pipe, 4: stator, 5: rotor, 6: electric motor element, 7: fixed scroll, 8: frame, 9: compression chamber, 10: orbiting scroll, 11: suction port, 12: compression mechanism, 13: rotary shaft, 14: silencing muffler, 15: silencing chamber, 16: discharge hole, 17: expansion part, 17*a*: acoustic analysis model, 18: chamber sub-port, 19: main port, 20: sub-port, 21: discharge valve, 22: valve guard, 23: outlet hole, 30: balancer, 31: expansion part, 31*a*: acoustic analysis model, 33: silencing chamber, 41: frequency band, 42: dip, 43: frequency band, 44: dip, 45: frequency band, 46: frequency band, 50: silencing chamber, 51: expansion part, 51*a*: acoustic analysis model, 60: silencing chamber, 61: expansion part, 61*a*: acoustic analysis model, 67: silencing chamber, 70: silencing chamber, 71: expansion part, 71*a*: acoustic analysis model, 100: scroll compressor, 101: flattened shape, 102: rectangle, 103: longitudinal direction, 104: straight line, 105: central axis, 201: flattened shape, 201*a*: flattened shape, 201*b*: flattened shape, 202*a*: rectangle, 202*b*: rectangle, 203*a*: longitudinal direction, 203*b*: longitudinal direction, 204: straight line, 301: flattened shape, 302: rectangle, 303: longitudinal direction, 304: straight line, 305: central axis, 401: flattened shape, 402: rectangle, 403: straight line, 404: point of contact, 405: one side, 406: central axis, 407: longitudinal direction.

The invention claimed is:

1. A scroll compressor including a compression mechanism, the compression mechanism including a compression chamber, the compression chamber being formed by a combination of a fixed scroll and an orbiting scroll and configured to compress working gas, the fixed scroll including a main port and a plurality of sub-ports, the main port being a port through which the working gas compressed in the compression chamber is to be discharged, the plurality of sub-ports being ports through which the working gas over-compressed in the compression chamber is to be discharged, the scroll compressor comprising:

a rotary shaft that drives the compression mechanism; and a silencing chamber disposed downstream of the main port with respect to a flow of the working gas, wherein the silencing chamber includes a discharge hole through which the working gas is to be discharged out of the silencing chamber, an expansion part located upstream of the discharge hole, the expansion part being a recess that defines a space communicating with the main port, and a plurality of chamber sub-ports each communicating with a corresponding one of the plurality of sub-ports, and wherein the expansion part is disposed between two of the plurality of chamber sub-ports, the expansion part being larger than the main port and having a flattened shape as seen in an axial direction of the rotary shaft.

2. The scroll compressor of claim 1, wherein as seen in the axial direction, a rectangle circumscribing the flattened shape of the expansion part has a length in a longitudinal direction larger than a shortest distance between the two chamber sub-ports.

3. The scroll compressor of claim 1, wherein as seen in the axial direction, the main port lies on a central axis, the central axis being a central axis in a transverse direction of a rectangle circumscribing the flattened shape.

4. The scroll compressor of claim 1, wherein as seen in the axial direction, the discharge hole lies on a central axis, the central axis being a central axis in a transverse direction of a rectangle circumscribing the flattened shape.

5. The scroll compressor of claim 1, wherein as seen in the axial direction, the expansion part has a shape obtained by connecting outlines of a plurality of flattened shapes, the plurality of flattened shapes being positioned to partially overlap each other.

6. The scroll compressor of claim 1, wherein as seen in the axial direction, the expansion part has two parts including one part and an other part, the one part having a cross-sectional area greater than a cross-sectional area of the other part, the two parts are formed by dividing the expansion part by a central axis that is a central axis in a transverse direction of a rectangle circumscribing the flattened shape.

7. The scroll compressor of claim 1, wherein as seen in the axial direction, a longitudinal direction of a rectangle circumscribing the flattened shape of the expansion part, and a straight line connecting respective centers of the two chamber sub-ports form an angle θ, the angle θ satisfying a condition that 45 degrees≤θ≤135 degrees.

* * * * *